US010888180B2

(12) United States Patent
Robinson

(10) Patent No.: US 10,888,180 B2
(45) Date of Patent: Jan. 12, 2021

(54) QUICK SETUP HUTCH UNIT

(71) Applicant: INTERNATIONAL PAPER COMPANY, Memphis, TN (US)

(72) Inventor: Kevin Edward Robinson, Wallingford, PA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/429,758

(22) Filed: Jun. 3, 2019

(65) Prior Publication Data

US 2020/0375375 A1 Dec. 3, 2020

(51) Int. Cl.

*A47F 5/11* (2006.01)
*A47F 5/00* (2006.01)
*A47B 43/02* (2006.01)

(52) U.S. Cl.

CPC ..... *A47F 5/116* (2013.01); *A47B 43/02* (2013.01); *A47F 5/0018* (2013.01); *A47B 2220/0086* (2013.01); *A47B 2230/0092* (2013.01); *A47B 2230/0096* (2013.01)

(58) Field of Classification Search

CPC ..... A47F 5/116; A47F 5/0018; A47F 5/11; A47F 5/112; A47F 5/114; A47B 43/02; A47B 47/06; A47B 55/06; A47B 2220/0086; A47B 2230/0092; A47B 2230/0096; B65D 5/5213; B65D 21/086

USPC .... 211/72, 73, 195, 135, 149, 175; 312/258, 312/259, 262; 229/120.31, 120.15, 229/120.19

See application file for complete search history.

(56) References Cited

U.S. PATENT DOCUMENTS 4,561,706 A * 12/1985 Grati ..... A47B 43/02 108/51.3
4,646,922 A * 3/1987 Smith ..... A47F 5/116 211/186
4,949,851 A * 8/1990 Shaffer ..... A47F 5/116 211/149
5,193,466 A * 3/1993 Eder ..... A47F 5/116 108/166

(Continued)

FOREIGN PATENT DOCUMENTS

BE 470560 A 1/1947
EP 3387960 A1 3/2018
WO WO-2015022673 A1 2/2015

*Primary Examiner* — Jennifer E. Novosad

(74) *Attorney, Agent, or Firm* — Michael D. Folkerts; Thomas W. Ryan

(57) ABSTRACT

A hutch unit including a front panel, a back panel, and two laterally opposing sidewalls hingedly connected to the front panel. One or more shelf units are provided, each shelf unit including a front shelf edge hingedly connected to the front panel and a rear shelf edge hingedly connected to the back panel. The back panel includes opposing lateral back edges, and first and second back flaps are hingedly connected to the lateral back edges extending forward from the back panel. Each of the first and second back flaps is positioned in abutting relationship to a respective sidewall to define first and second overlapping sidewall portions along each sidewall. Vertical sliding connections join the back flaps to the sidewalls at the overlapping sidewall portions, wherein the vertical sliding connections guide the back panel in vertical displacement relative to the sidewalls.

21 Claims, 6 Drawing Sheets

(56) References Cited

U.S. PATENT DOCUMENTS 5,443,168 A * 8/1995 Dyment ..... A47F 5/116 211/149
6,378,710 B1 * 4/2002 Grueneberg ..... A47F 5/116 211/132.1
6,715,623 B2 * 4/2004 Broerman ..... A47F 5/116 211/149
7,007,615 B2 * 3/2006 Grueneberg ..... A47B 43/02 108/165
7,571,820 B2 * 8/2009 Alexander ..... A47F 5/10 211/73
7,703,864 B2 * 4/2010 Moser ..... B65D 5/5213 206/747
8,157,112 B2 * 4/2012 Bojie ..... A47F 5/11 211/135
8,485,370 B2 * 7/2013 Dewhurst ..... A47F 5/116 211/135
8,875,908 B2 * 11/2014 L'Hotel ..... A47B 47/06 211/72
8,939,091 B2 * 1/2015 Suzuki ..... A47F 5/10 108/106
9,211,021 B2 * 12/2015 Smith ..... A47F 5/116
9,474,389 B2 * 10/2016 Pfeifer ..... A47F 5/11
9,743,783 B1 * 8/2017 Bersamin ..... A47F 5/116
9,844,282 B2 * 12/2017 Smith ..... A47F 5/116
9,907,414 B2 * 3/2018 Heuer ..... A47B 43/00
10,123,635 B2 * 11/2018 Lilja ..... A47B 43/02
10,470,591 B1 * 11/2019 Heiden ..... A47F 5/116
10,531,750 B1 * 1/2020 Heiden ..... A47F 5/0018
10,568,439 B2 * 2/2020 Bersamin ..... A47F 5/116
2004/0148825 A1 * 8/2004 Myers ..... A47F 5/116 40/124
2010/0006527 A1 1/2010 Kalwat et al.
2010/0006529 A1 1/2010 Groff et al.
2010/0276378 A1 * 11/2010 Chen ..... A47F 5/114 211/1
2012/0111764 A1 * 5/2012 Lackey ..... A47F 5/005 206/736
2013/0062299 A1 * 3/2013 Beaty ..... A47F 5/116 211/153
2015/0136720 A1 * 5/2015 Miller ..... A47B 47/00 211/135
2018/0070747 A1 3/2018 Smith
2018/0289178 A1 * 10/2018 McMillan-Sweat .... A47F 5/116
2019/0069694 A1 3/2019 Smith

* cited by examiner

QUICK SETUP HUTCH UNIT

FIELD OF THE INVENTION

The present invention relates to a display hutch and, more particularly, to a display hutch that can be converted from a collapsed configuration to an erected configuration

BACKGROUND OF THE INVENTION

Merchandising displays made from corrugated paper are known, wherein the relatively low expense of the material, its structural qualities, and the ease with which it can be manipulated has resulted in the development of various forms of merchandising displays. In general, corrugated paper merchandising displays have been constructed having vertically extending sides and including one or more bins formed in the display for displaying merchandise. To ensure that the merchandising display is formed with adequate structural strength, such displays can often include a bulky construction with multiple parts required for on-site assembly, and can require relatively complex and/or time-consuming construction to prepare the display for use.

Alternatively, in order to simplify construction of the display, folding displays have been developed that may include shelves formed integrally with wall portions of the display to reduce the parts inventory for assembling the display. Such folding displays may be shipped in a folded configuration and manipulated to an erected configuration at a point of sale location. The folding displays may require separate manipulation of the shelves to a use position and/or may include a sliding panel internal to the structure of the display that can be operated to manipulate the shelves and to facilitate unfolding of the display to an erected configuration. There is a need for a display structure that can be easily converted from a folded configuration to an erected configuration and that can provide improved stability to the erected display structure.

SUMMARY OF THE INVENTION

In accordance with an aspect of the invention, a hutch unit is provided comprising a front panel, a back panel, and two laterally opposing sidewalls, each sidewall including a front sidewall edge hingedly connected to the front panel along a front sidewall fold line. One or more shelf units are provided, each shelf unit including a front shelf edge hingedly connected to the front panel and a rear shelf edge hingedly connected to the back panel. The back panel includes opposing lateral back edges. First and second back flaps are hingedly connected to the lateral back edges extending forward from the back panel. Each of the first and second back flaps is positioned in abutting relationship to a respective sidewall to define first and second overlapping sidewall portions along each sidewall. Vertical sliding connections join the back flaps to the sidewalls at the overlapping sidewall portions, wherein the vertical sliding connections guide the back panel in vertical displacement relative to the sidewalls.

The front panel, back panel, and sidewalls may each define an outer surface of the hutch unit.

Each sidewall may comprise a front sidewall section and a back sidewall section hingedly connected to each other along a vertical sidewall fold line parallel to the front sidewall fold lines.

The overlapping sidewall portions may be defined along the back sidewall sections.

The vertical sliding connection on each overlapping sidewall portion may be defined by a vertically elongated slot defined in one of the back flap and the back sidewall section, and a connecting member extending from the other of the back flap and the back sidewall section through the vertically elongated slot.

The hutch unit may be convertible between a first, flat configuration in which the front and back sidewall sections of each sidewall are positioned in abutting relationship, and a second, erected configuration in which the front and back sidewall sections of each sidewall are positioned in substantially coplanar relationship.

The one or more shelf units may be positioned in substantially flat abutting relationship to the front and back panels in the first, flat configuration, and the one or more shelf units may be positioned to define one or more support surfaces between the front and back panels and extend adjacent to the front and back sidewall sections of each sidewall in the second, erected configuration.

The vertical sliding connection on each overlapping sidewall portion may be defined by a vertically elongated slot defined in one of the back flap and the sidewall, and a connecting member extending from the other of the back flap and the sidewall through the vertically elongated slot.

A pair of vertically spaced vertical sliding connections may be provided on each of the overlapping sidewall portions.

One or more of the shelf units may include a generally planar shelf panel defining the front and rear shelf edges and opposing lateral shelf edges, and a shelf flap hingedly connected to each lateral shelf edge and extending between the front and rear shelf edges generally parallel to the sidewalls.

In accordance with another aspect of the invention, a hutch unit is provided comprising a front panel, a back panel, and two laterally opposing sidewalls, each sidewall including a front sidewall edge hingedly connected to the front panel along front sidewall fold lines. One or more shelf units are provided, each shelf unit including a generally planar shelf panel defining a front shelf edge hingedly connected to the front panel, a rear shelf edge hingedly connected to the back panel, and opposing lateral shelf edges. The back panel defines an outer surface of the hutch unit supported on each of the sidewalls for vertical displacement relative to the sidewalls parallel to the front sidewall fold lines.

First and second back flaps may be hingedly connected to opposing lateral back edges of the back panel and extend forward from the back panel, each of the first and second back flaps positioned in abutting relationship to a respective sidewall to define first and second overlapping sidewall portions along each sidewall.

Vertical sliding connections may join the back flaps to the sidewalls at the overlapping sidewall portions, wherein the vertical sliding connections can guide the back panel in the vertical displacement relative to the sidewalls.

Each sidewall may comprise a front sidewall section and a back sidewall section hingedly connected to each other along a vertical sidewall fold line parallel to the front sidewall fold lines, and the overlapping sidewall portions may be defined along the back sidewall sections.

Each of the back flaps may include a pair of vertically elongated slots extending parallel to the front sidewall fold lines, and a pair of vertical sliding connections may be provided on each of the overlapping sidewall portions by a shaft of a fastener extending through a respective vertically elongated slot in the back flap and through an adjacent back sidewall section.

The hutch unit may be convertible between a first, flat configuration in which the front and back sidewall sections of each sidewall are positioned in abutting relationship, and a second, erected configuration in which the front and back sidewall sections of each sidewall are positioned in substantially coplanar relationship.

In accordance with a further aspect of the invention, a method of assembling a hutch unit is provided comprising providing a first blank comprising a front panel having lateral front edges and sidewalls hingedly connected to the front panel at respective front sidewall fold lines defined at the lateral front edges, and shelf openings defined in the front panel and vertically separated by front face sections; providing a second blank comprising a back panel having lateral back edges and back flaps hingedly connected to the back panel at respective back fold lines defined at the lateral back edges; folding the sidewalls of the first blank about the front sidewall fold lines to form a generally U-shaped front member; folding the back flaps of the second blank about the back fold lines to form a generally U-shaped back member; positioning the back flaps in overlapping relation to respective ones of the sidewalls to define first and second overlapping sidewall portions; positioning connecting members through each of the first and second overlapping portions including positioning each connecting member through a vertically elongated slot, extending parallel to the front sidewall fold lines, defined in at least one of the back flap and the sidewall of each overlapping portion to form a vertical sliding connection; wherein positioning the back flaps in overlapping relation to respective ones of the sidewalls includes positioning shelf units generally perpendicular to the front panel and connected to the front panel and the back panel.

Each shelf unit may be formed from a third blank including a generally planar shelf panel and a front shelf tab hingedly connected to a front shelf edge and attached to a respective front face section, and positioning the shelf units may comprise pivoting the shelf units from a position generally parallel the front panel to a position generally perpendicular to the front panel.

Shelf flaps may be provided hingedly connected to the shelf panel at opposing lateral shelf edges, and positioning the shelf units may include folding the shelf flaps generally perpendicular to the shelf panel.

The third blank may further comprise a rear shelf tab extending from a rear shelf edge of the shelf panel, and positioning the back flaps in overlapping relation to respective ones of the sidewalls may include moving the front panel and back panel toward each other to position the rear shelf tab of each shelf unit through a respective horizontal slot in the back panel.

Each sidewall may include front and back sidewall sections hingedly joined at respective vertical sidewall fold lines parallel to the front sidewall fold lines, and positioning connecting members through the overlapping portions may comprise positioning a pair of connecting members through each of the back sidewall sections at vertically spaced locations aligned with respective vertically elongated slots.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

In the following description, as will be appreciated, terms such as "horizontal," "vertical," "left," "right," "upward," "downward," "top," "bottom," "front", "back", "rear", etc., either used as nouns, adjectives or adverbs (e.g. "horizontally, "upwardly," etc.), refer in this description to the orientation of the structure of the hutch as it is illustrated in the figures when that hutch unit is supported on a horizontal support surface, e.g., a floor surface, facing the reader. Such terms are not intended to limit the invention to a particular orientation. The term "connected," when used to describe the relationship between two or more structures, means that such structures are secured or attached either directly or indirectly through intervening structures and can include movable connections such as pivoting and/or sliding connections.

Figure 8:
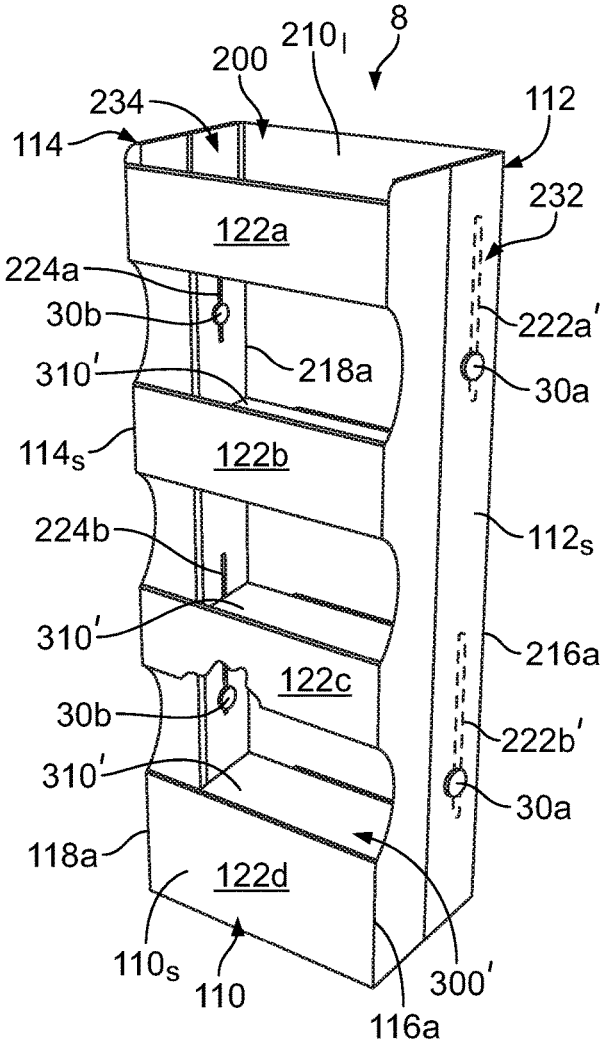
FIG. 8 is a front perspective view of an erected hutch unit.

The present description is directed to a construction that provides a display hutch unit 8, see FIG. 8, that can be set up quickly from a folded state to an erected state to form a stable floor display having one or more shelf units, and preferably can include a plurality of vertically spaced shelf units. Generally, the hutch unit 8 can be constructed from a first, hutch front blank 100, a second, U-back blank 200, and a third, shelf blank 300, see FIGS. 1-3. Each of the first, second, and third blanks 100, 200, 300 can be formed of corrugated cardboard and may be joined or connected to define the hutch unit 8 as a corrugated cardboard construction.

Figure 1:
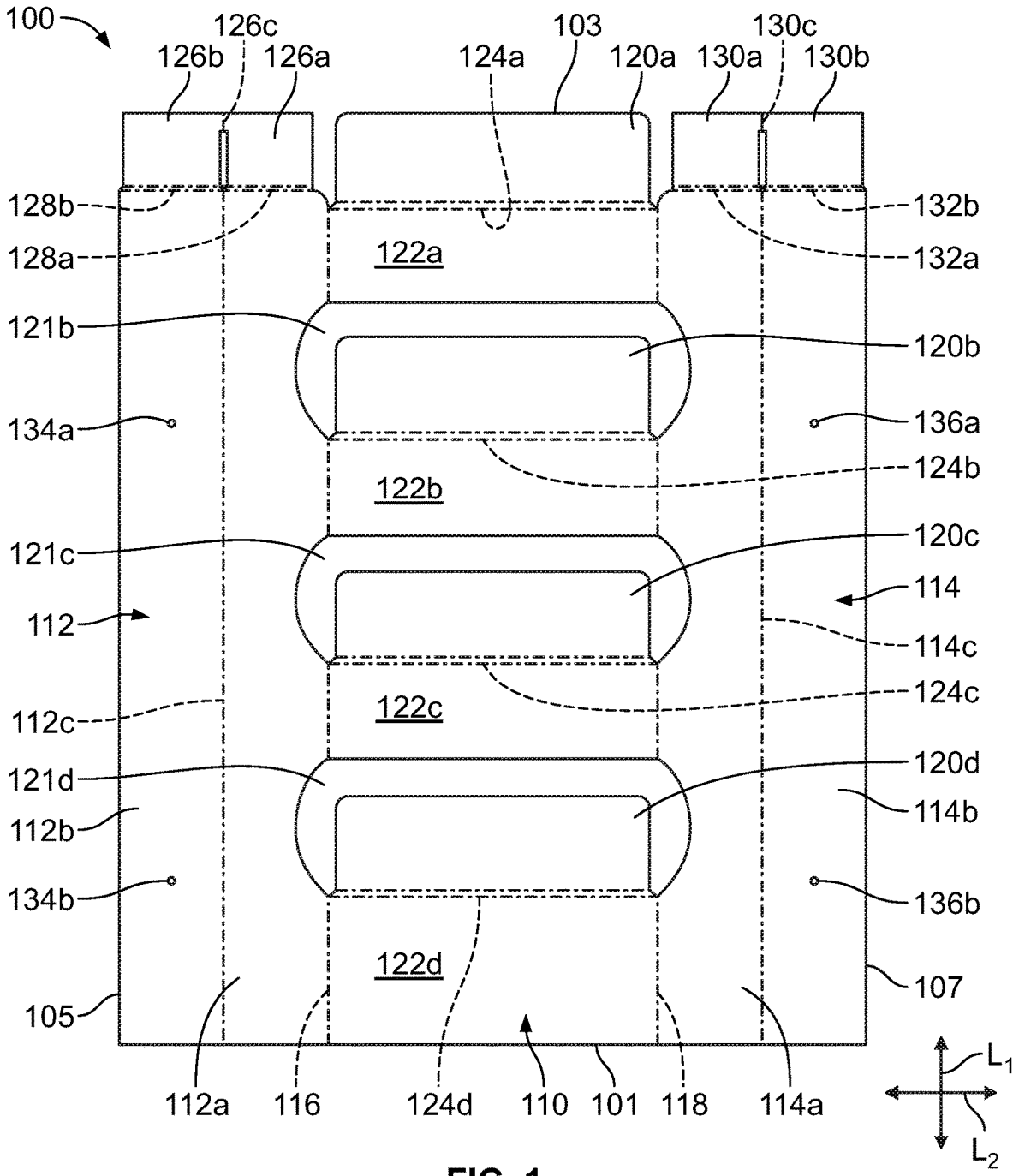
FIG. 1 is plan view of a first blank for forming a U-shaped front member of a hutch unit described herein.

Referring to FIG. 1, the hutch front blank 100 extends in a longitudinal direction $L_1$ between opposing first and second longitudinal edges, generally designated 101, 103, respectively, and further extends in a lateral direction $L_2$, between first and second lateral edges, generally designated 105, 107, respectively, and extending transverse to the longitudinal edges 101, 103. The hutch front blank 100 includes a central or front panel 110 and right and left sidewalls 112, 114 on opposing lateral sides of the front panel 110. The right sidewall 112 is hingedly joined to the front panel 110 at a first front sidewall fold line 116 to define a front sidewall edge 116*a* on the hutch unit 8, and the left sidewall 114 is hingedly joined to the front panel 110 at a second front sidewall fold line 118 to define a front sidewall edge 118*a* on the hutch unit 8, see FIGS. 1 and 8. The front sidewall edges 116*a*, 118*a* correspond to lateral front edges of the front panel 110. The right sidewall 112 includes a front sidewall section 112*a* and a back sidewall section 112*b* that are hingedly joined together at a vertical fold line 112*c*. The left sidewall 114 includes a front sidewall section 114*a* and a back sidewall section 114*b* that are hingedly joined together at a vertical fold line 114*c*. The front sidewall sections 112*a*, 114*a* can have a lateral dimension, from the lateral edges 105, 107 to the respective vertical fold line 112*c*, 114*c*, that is generally equal to a lateral dimension of respective back sidewall sections 112*b*, 114*b*, from the vertical fold lines 112*c*, 114*c* to the respective lateral edges 105, 107.

Front flaps 120*a*, 120*b*, 120*c*, 120*d* are hingedly attached to front face sections 122*a*, 122*b*, 122*c*, 122*d* of the front panel 110 at respective fold lines 124*a*, 124*b*, 124*c*, 124*d*, wherein the fold lines 124*a*, 124*b*, 124*c*, 124*d* can comprise double fold lines. The front flaps 120*b*, 120*c*, 120*d* are defined within cutout areas of the front panel 110 forming front shelf openings 121*b*, 121*c*, 121*d* that are vertically separated by the front face sections 122*b* and 122*c*. Further, the front shelf openings 121*b*, 121*c*, 121*d* may extend laterally past the front sidewall fold lines 116, 118 partially into the respective front sidewall sections 112*a*, 114*a*, as can be seen in FIG. 1.

A pair of upper edge flaps 126*a*, 126*b* are located adjacent to the second longitudinal edge 103 and are hingedly joined to the front and back sidewall sections 112*a*, 112*b* at respective fold lines 128*a*, 128*b*, wherein the fold lines 128*a*, 128*b* can be double fold lines. Similarly, a pair of upper edge flaps 130*a*, 130*b* are located adjacent to the second longitudinal edge 103 and are hingedly joined to the front and back sidewall sections 114*a*, 114*b* at respective fold lines 132*a*, 132*b*, wherein the fold lines 132*a*, 132*b* can be double fold lines. The upper edge flaps 126*a*, 126*b* can be joined to each other along at least a portion of the upper edge flaps 126*a*, 126*b* extending from the second longitudinal edge 103 to define a fold joint 126*c*. The upper edge flaps 130*a*, 130*b* can be joined to each other along at least a portion of the upper edge flaps 130*a*, 130*b* extending from the second longitudinal edge 103 to define a fold joint 130*c*.

The back sidewall section 112*b* can further include upper and lower connector apertures 134*a*, 134*b*, and the back sidewall section 114*b* can include upper and lower connector apertures 136*a*, 136*b*. The connector apertures 134*a*, 134*b* and 136*a*, 136*b* are located and configured to receive connecting members, as will be described further below.

Figure 2:
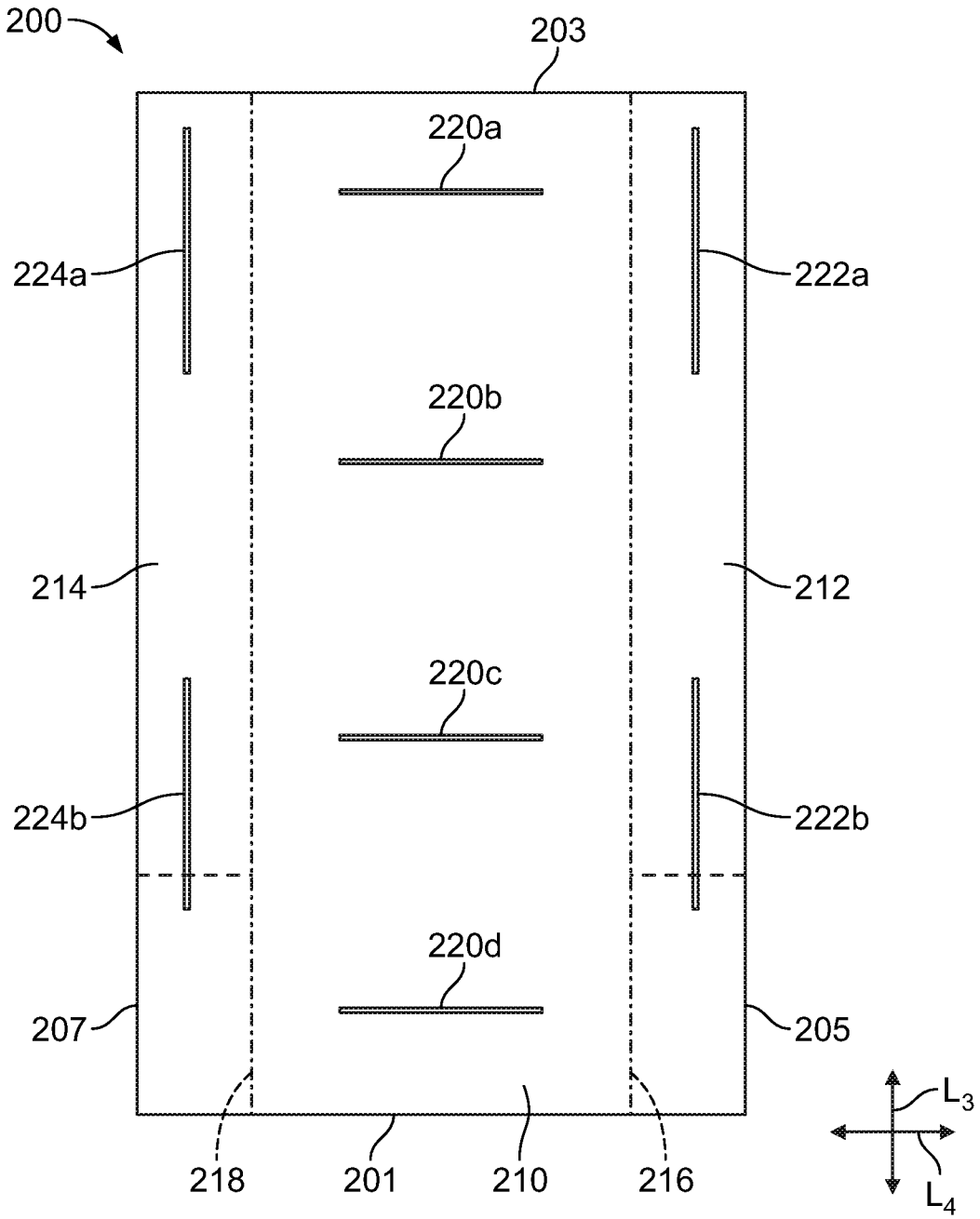
FIG. 2 is a plan view of a second blank for forming a U-shaped back member of the hutch unit.

Referring to FIG. 2, the U-back blank 200 extends in a longitudinal direction $L_3$ between opposing first and second longitudinal edges, generally designated 201, 203, respectively, and further extends in a lateral direction $L_4$, between first and second lateral edges, generally designated 205, 207, respectively, and extending transverse to the longitudinal edges 201, 203. The U-back blank 200 includes a back panel 210, and first and second back flaps 212, 214 at opposing lateral sides of the back panel 210. The first back flap 212 is hingedly joined to the back panel 210 at a first back fold line 216 to define a first lateral back edge 216*a* on the hutch unit 8, and the second back flap 214 is hingedly joined to the back panel 210 at a second back fold line 218 to define a second lateral back edge 218*a* on the hutch unit 8, see FIGS. 1 and 8.

The back panel 210 can have a lateral dimension, from the first back fold line 216 to the second back fold line 218, that is generally equal to a lateral dimension of the front panel 110, from the first front sidewall fold line 116 to the second front sidewall fold line 118. The back panel 210 can have a longitudinal dimension, from the first longitudinal edge 201 to the second longitudinal edge 203, that is generally equal to a longitudinal dimension of the sidewalls 112, 114, from the first longitudinal edge 101 to the fold lines 128*a*, 128*b*, 132*a*, 132*b*. Further, each of the back flaps 212, 214 can have a lateral dimension, from the lateral edges 205, 207 to respective first and second back fold lines 216, 218, that is slightly less than, e.g., about ½ inch less than, the lateral dimension of the respective back sidewall sections 112*b*, 114*b*.

The first back flap 212 includes upper and lower vertically spaced, vertically or longitudinally extending slots 222*a*, 222*b*, and the second back flap 214 includes upper and lower vertically spaced, vertically or longitudinally extending slots 224*a*, 224*b*. The back panel 210 further includes a plurality of vertically spaced, horizontally or laterally extending slots 220*a*, 220*b*, 220*c*, 220*d*. The number of horizontally extending slots 220*a*, 220*b*, 220*c*, 220*d* can be equal to the number of front face sections 122*a*, 122*b*, 122*c*, 122*d* on the front panel 110.

Figure 3:
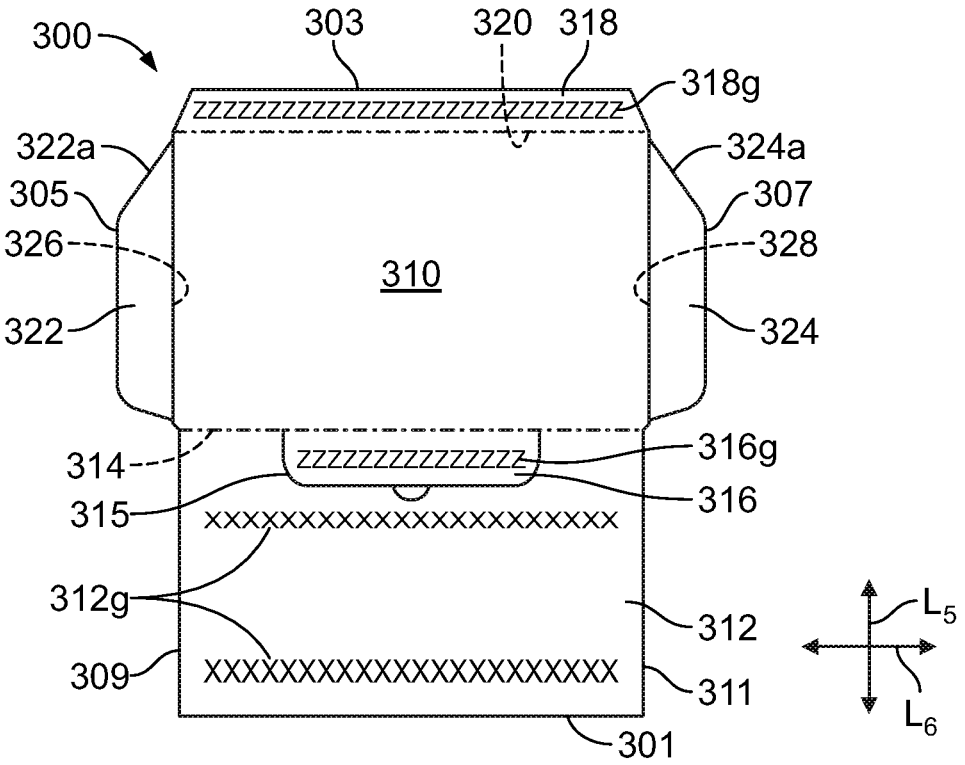
FIG. 3 is a plan view of a third blank for forming a shelf unit of the hutch unit.

Referring to FIG. 3, the shelf blank 300 extends in a longitudinal direction $L_5$ between opposing first and second longitudinal edges, generally designated 301, 303, respectively, and further extends in a lateral direction $L_6$, between first and second lateral edges, generally designated 305, 307, respectively, and extending transverse to the longitudinal edges 301, 303. The shelf blank 300 includes a main body 310 and a reinforcing flap 312 hingedly joined to the main body 310 at a fold line defined along a rear shelf edge 314. A rear shelf tab 316 is defined by a through cut line 315 in a laterally central portion the reinforcing flap 312, wherein the rear shelf tab 316 is hingedly joined to the main body 310 at the rear shelf edge 314. A front shelf tab 318 is hingedly joined to the main body 310 at a fold line defined along a front shelf edge 320. First and second shelf flaps 322, 324 are hingedly joined to opposing lateral sides of the main body 310 at fold lines defined along respective first and second lateral shelf edges 326, 328 and extend between the front and rear shelf edges 320, 314, wherein the shelf flaps 322, 324 can include respective tapered forward edges 322*a*, 324*a*.

The reinforcing flap 312 has a longitudinal dimension, from the rear shelf edge 314 to the first longitudinal edge 301, that is generally equal to or slightly less than a longitudinal dimension of the main body 310, from the rear shelf edge 314 to the front shelf edge 320. Further, the reinforcing flap 312 has a lateral dimension, from a first reinforcing flap edge 309 to a second reinforcing flap edge 311, that is generally equal to or slightly less than a lateral dimension of the main body 310, from the first lateral shelf edge 326 to the second lateral shelf edge 328. Additionally, the lateral dimension of the main body 310 can be generally equal to the lateral dimension of the front panel 110, as described above, and the longitudinal dimension of the main body 310 can be generally equal to a horizontal or lateral dimension of the sidewalls 112, 114, from lateral edges 105, 107 to the respective first and second front sidewall fold lines 116, 118.

In a construction of the hutch unit 8, as illustrated in FIGS. 4-8, one or more of the shelf blanks 300 can be provided for attachment to the hutch front blank 100, wherein each shelf blank 300 is initially folded to define a shelf unit 300', and the front panel 110 is initially folded prior to mounting one or more of the shelf units 300'. In particular, folding of the shelf blank 300 includes applying adhesive, e.g., glue, to at least one of the main body 310 and the reinforcing flap 312, as is illustrated in FIG. 3 by glue locations $\mathbf{312}_g$ on the reinforcing flap 312. The reinforcing flap 312 is pivoted about the rear shelf edge 314 to overlap and adhere the reinforcing flap 312 to the main body 310 to define the shelf unit 300', see FIG. 4. It may be noted that the overlapping main body 310 and reinforcing flap 312 can define a generally planar shelf panel 310'.

Initial folding of the front panel 110 includes applying adhesive, e.g., glue, to at least one of the front flaps 120*a*, 120*b*, 120*c*, 120*d* and rear surfaces of the front face sections 122*a*, 122*b*, 122*c*, 122*d*, i.e., adhesive can be applied to front flap and/or front face section surfaces of the front panel 110 facing out of the page in FIG. 1. The front flaps 120*a*, 120*b*, 120*c*, 120*d* are pivoted about the respective fold lines 124*a*, 124*b*, 124*c*, 124*d* to overlap and adhere to rear surfaces of the respective front face sections 122*a*, 122*b*, 122*c*, 122*d*, see FIG. 4. Overlapping the front flaps 120*a*, 120*b*, 120*c*, 120*d* on the rear surfaces of the front face sections 122*a*, 122*b*, 122*c*, 122*d* provides a reinforcement for strengthening the front face sections 122*a*, 122*b*, 122*c*, 122*d*.

Figure 4:
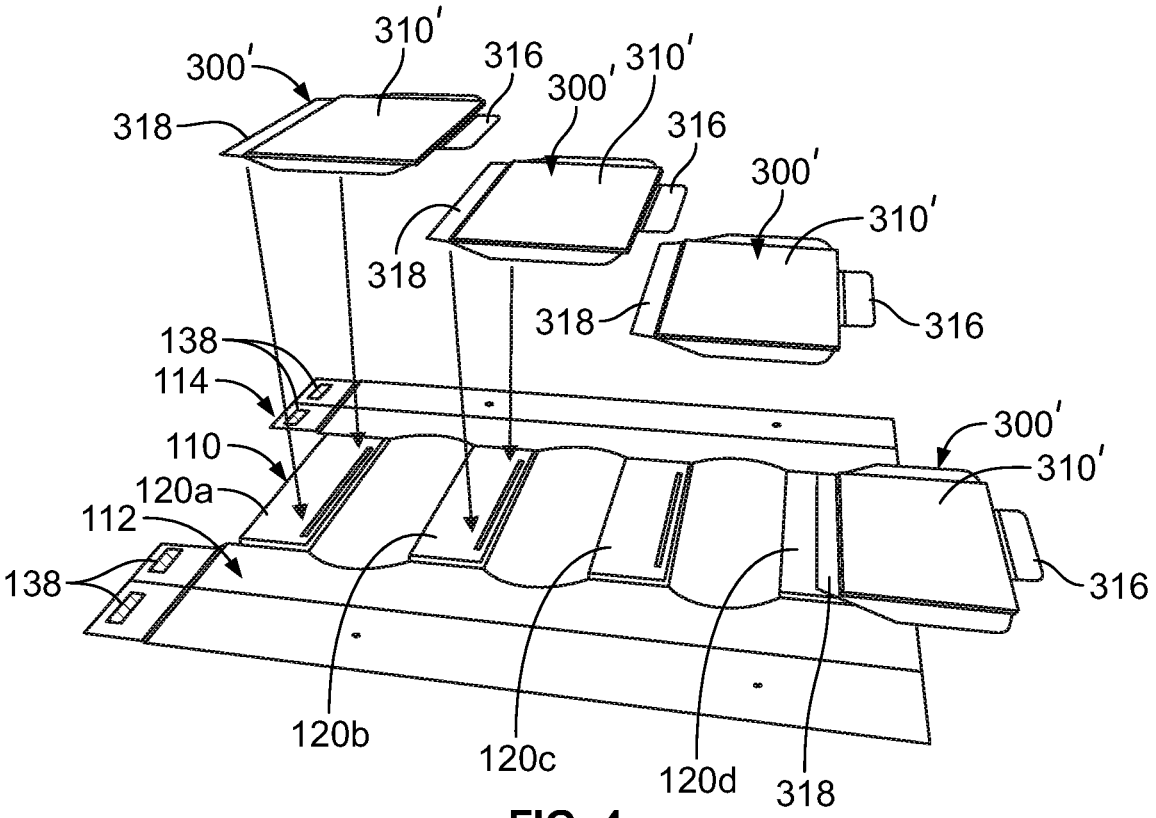
FIG. 4 is a perspective view of a step for assembling shelf units to the first blank.

As seen in FIG. 4, the front shelf tab 318 of each shelf unit 300' can be mounted to a respective front flap 120*a*, 120*b*, 120*c*, 120*d* of the front panel 110, such that each shelf unit 300' is hingedly attached to the front panel 110. For example, mounting the shelf units 300' to the front panel 110 can include applying adhesive, e.g., glue, to at least one of the front flaps 120*a*, 120*b*, 120*c*, 120*d* and the front shelf tab 318, as is illustrated in FIG. 3 by the glue location $\mathbf{318}_g$ on the front shelf tab 318. It should be noted that the front shelf tabs 318 of the shelf units 300' may be attached adjacent a bottom edge of the respective front flaps 120*a*, 120*b*, 120*c*, 120*d* with the shelf panels 310' initially extending parallel to the front panel 110 in preparation for assembly and connection of the front blank 100 to the U-back blank 200.

Figure 6:
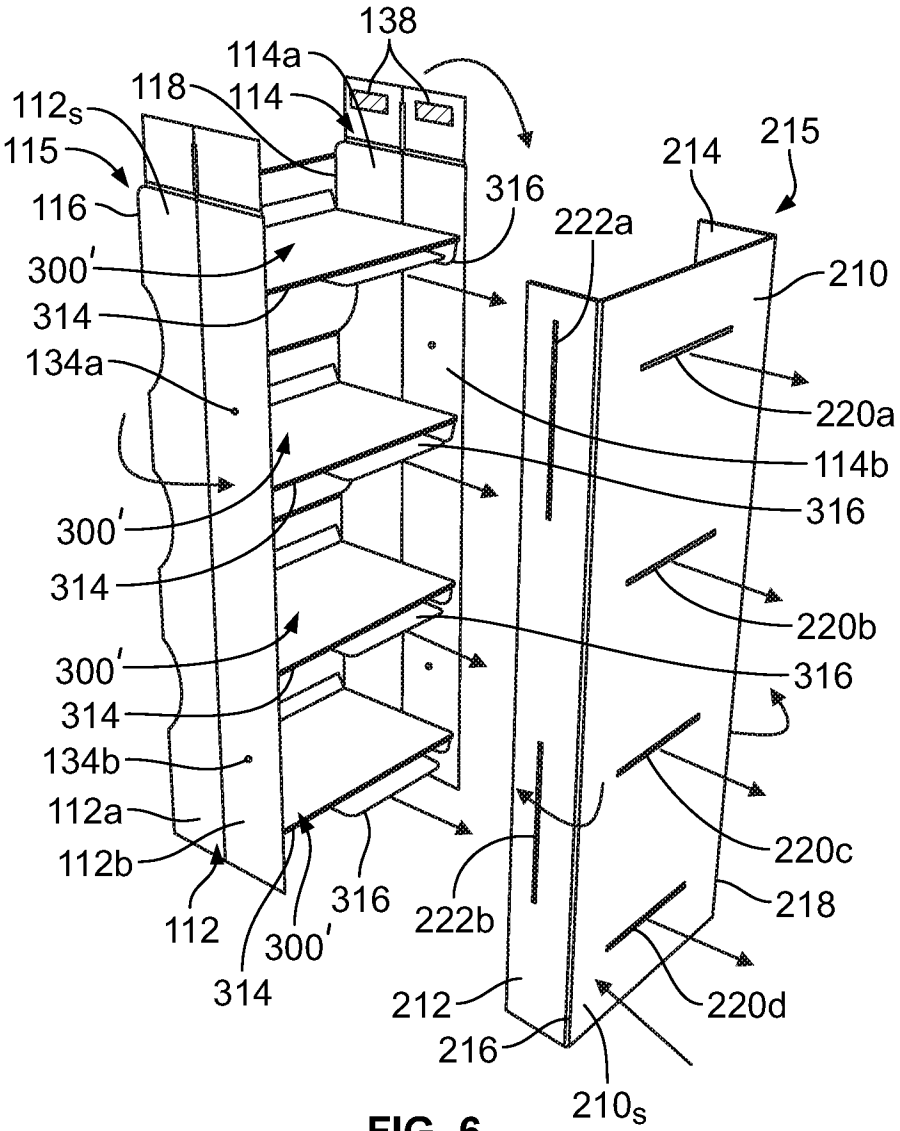
FIG. 6 is a perspective view of the first blank and shelf units configured as a U-shaped front member and illustrating assembly to the back member.
Figure 5:
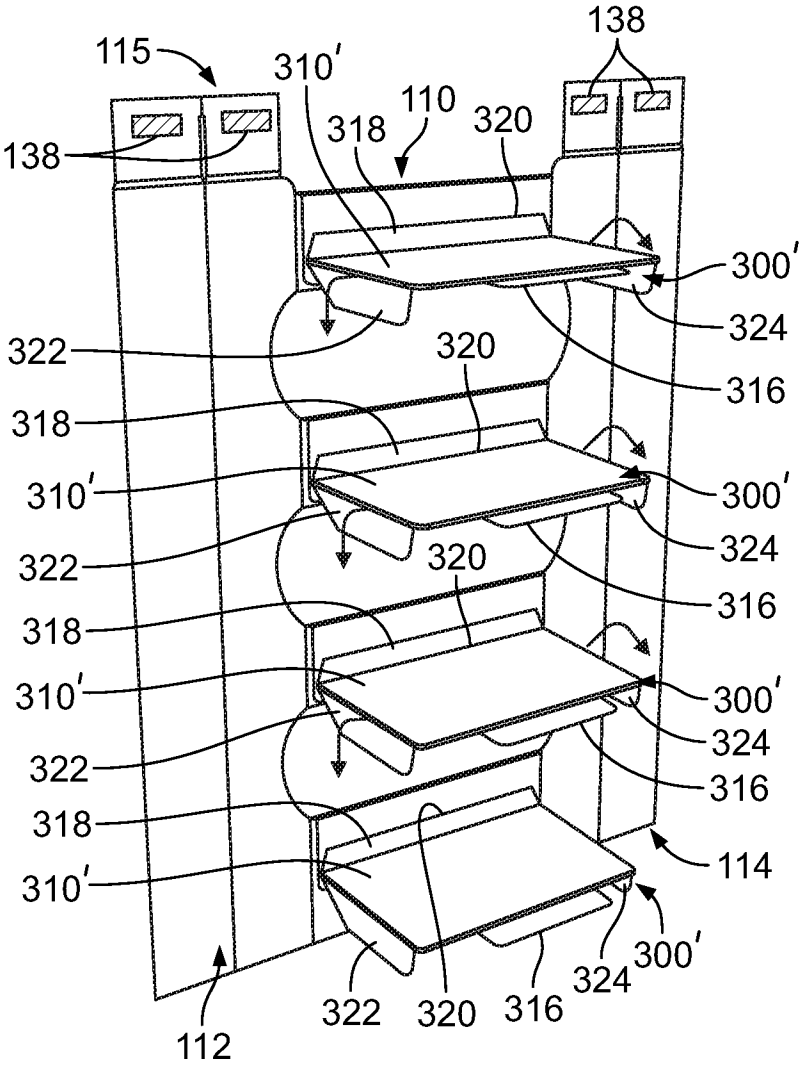
FIG. 5 is a perspective view of the first blank with shelf units positioned and configured for assembly to the back member.

Referring to FIG. 5, the shelf units 300' can be pivoted about the front shelf edge 320 away from the front panel 110 to a position generally perpendicular to the front panel 110, and each of the shelf flaps 322, 324 can be pivoted about the lateral shelf edges 326, 328 to a position generally perpendicular to a respective shelf panel 310'. Referring further to FIG. 6, the sidewalls 112, 114 are pivoted back about the front sidewall fold lines 116, 118 to a position generally perpendicular to the front panel 110, wherein the sidewalls 112, 114 are located adjacent to and abutting the first and second shelf flaps 322, 324 of the shelf units 300' to form a generally U-shaped front member 115.

Referring to FIG. 6, the back flaps 212, 214 of the U-back blank 200 are pivoted forward about the back fold lines 216, 218 to a position generally perpendicular to the back panel 210 to form a generally U-shaped back member 215. Subsequently, the front member 115 and the back member 215 are moved or positioned toward each another, wherein the back flaps 212, 214 can be inserted between the lateral shelf edges 326, 328 of each shelf unit 300' and the back sidewall sections 112*b*, 114*b*, such that the back flaps 212, 214 are positioned in abutting relation to the back sidewall sections 112*b*, 114*b* to define respective overlapping sidewall portions 232, 234, see FIGS. 7 and 8.

Figure 7:
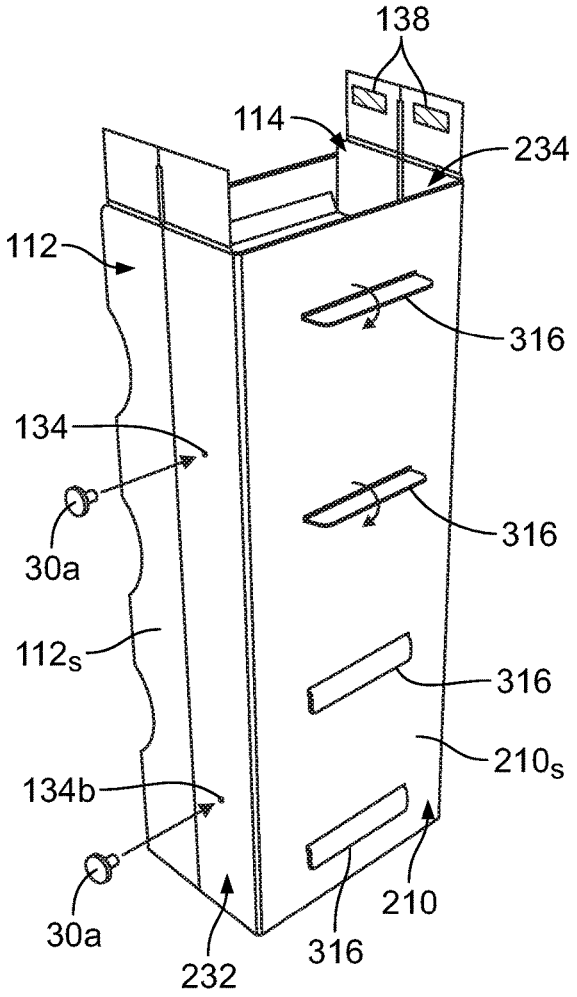
FIG. 7 is a rear perspective view of the hutch unit illustrating attachment of rear shelf tabs to the back panel and attachment of connecting members to a sidewall of the hutch.

Movement of the front and back members 115, 215 together includes positioning the rear shelf tabs 316 of the shelf units 300' through the horizontal slots 220*a*, 220*b*, 220*c*, 220*d* in the back panel 210, as illustrated by the upper two rear shelf tabs 316 in FIG. 7, which locates the rear shelf edge 314 closely adjacent to an inner surface 2101 of the back panel 210 see FIG. 8. The rear shelf tabs 316 can be attached to an outer surface 210*s* of the back panel 210, see FIG. 7, to maintain the rear shelf edges 314 adjacent to the back panel 210. Attachment of each rear shelf tab 316 to the back panel 210 can include applying adhesive, e.g., glue, to at least one of the rear shelf tab 316 and the back panel 210, as is illustrated in FIG. 3 by the glue location $\mathbf{316}_g$ on the rear shelf tab 316. The rear shelf tabs 316 can be folded perpendicular the respective shelf units 300' and adhered to the outer surface 210*s* of the back panel 210, as illustrated by the lower two rear shelf tabs 316 in FIG. 7, to hingedly support the shelf units 300' to the back panel 210.

Referring to FIGS. 7 and 8, positioning the back member 215 in association with the front member 115 aligns the upper and lower connector apertures 134*a*, 134*b* of the front member 115 with respective vertically extending slots 222*a*, 222*b* of the back member 215, and aligns the upper and lower connector apertures 136*a*, 136*b* of the front member 115 with respective vertically extending slots 224*a*, 224*b* of the back member 215. Connecting members or fasteners are provided for joining or connecting the front member 115 and back member 215 at vertical sliding connections to guide the back member 215 in vertical sliding movement, i.e., in the longitudinal direction L3, relative to the front member 115. Alternatively, the vertical sliding connections may be formed by a connecting member or fastener extending through vertically elongated slots defined in the sidewall sections 112*b*, 114*b* of the sidewalls 112, 114, as is depicted diagrammatically by dotted line slots 222*a*' and 222*b*' in FIG. 8.

Figure 9:
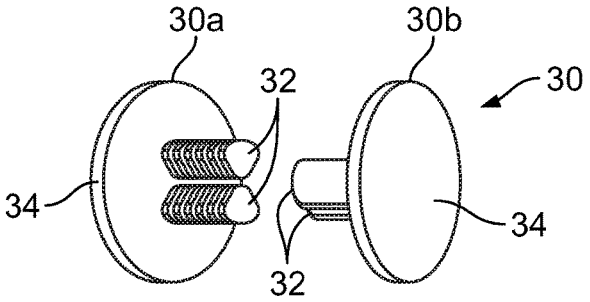
FIG. 9 is a perspective view of components forming a ratchet rivet connecting member.

An exemplary fastener can be a ratchet rivet 30 comprising outer and inner rivet elements 30*a*, 30*b*, as illustrated in FIG. 9. Each rivet element 30*a*, 30*b* can include a rivet head 34 and a pair of shaft segments 32 extending from one side of the rivet head 34. The shaft segments 32 of both rivet elements 30*a*, 30*b* can extending through a connector aperture 134*a*, 134*b*, 136*a*, 136*b* and through a respective adjacent slot 222*a*, 222*b*, 224*a*, 224*b*, wherein ribs on the shaft segments 32 on one rivet element 30*a*, 30*b* can engage with ribs on adjacently extending shaft segments 32 of the other rivet element 30*a*, 30*b* to lock the rivet elements 30*a*, 30*b* together and define a fastener shaft.

It may be understood that for each connecting member forming a vertical sliding connection, the rivet head 34 of one rivet element 30*a*, 30*b* may be engaged against a surface of one of the back sidewall segments 112*b*, 114*b* and the back flaps 212, 214, and the rivet head 34 of the other of the rivet elements 30*a*, 30*b* may be engaged on an oppositely facing surface of the other of a respective one of the back sidewall segments 112*b*, 114*b* and the back flaps 212, 214. Further, it may be understood that the described ratchet rivet 30 is an exemplary embodiment of a fastener for forming the sliding connections for the hutch unit 8, and that other fasteners or connecting members may be implemented including, without limitation, bolts, screws, etc.

Construction of the hutch unit 8 can further include folding the upper edge flaps 126*a*, 126*b* and 130*a*, 130*b* about the respective fold lines 128*a*, 128*b* and 132*a*, 132*b*, and adhering the upper edge flaps 126*a*, 130*a* and 126*b*, 130*b* to respective sidewall sections 112*a*, 114*a* and back flaps 212, 214. For example, double sided tape 138 may be provided on the upper edge flaps 126*a*, 130*a* and 126*b*, 130*b* to adhere to respective adjacent sidewall sections 112*a*, 114*a* and back flaps 212, 214, see FIG. 7. FIG. 8 illustrates a constructed hutch unit 8 following attachment of the upper edge flaps 126*a*, 126*b*, 130*a*, 130*b*.

Figure 10:
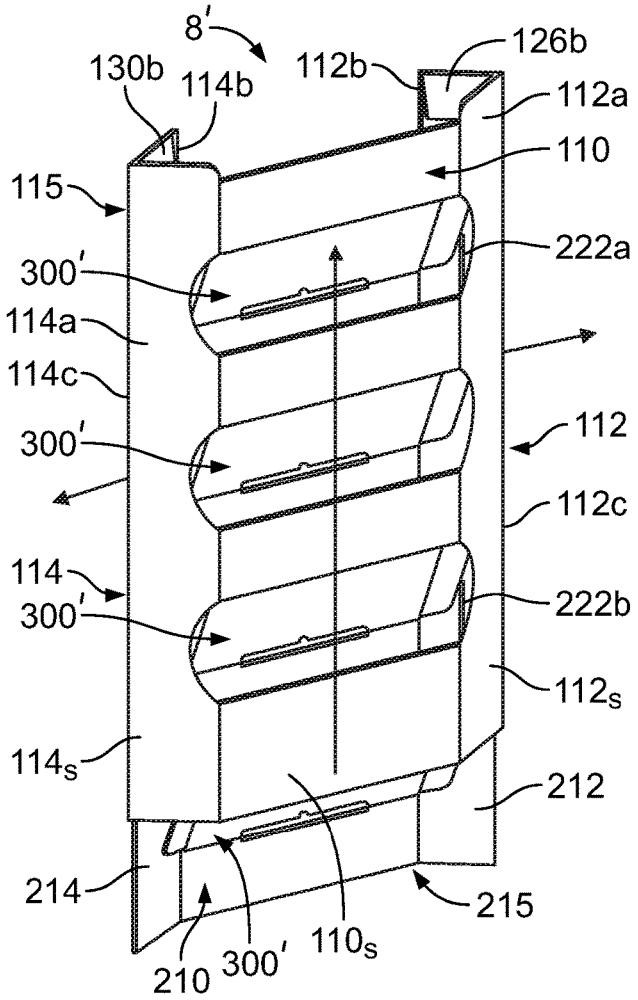
FIG. 10 is a perspective view of a hutch unit in a partially collapsed configuration.
Figure 11A:
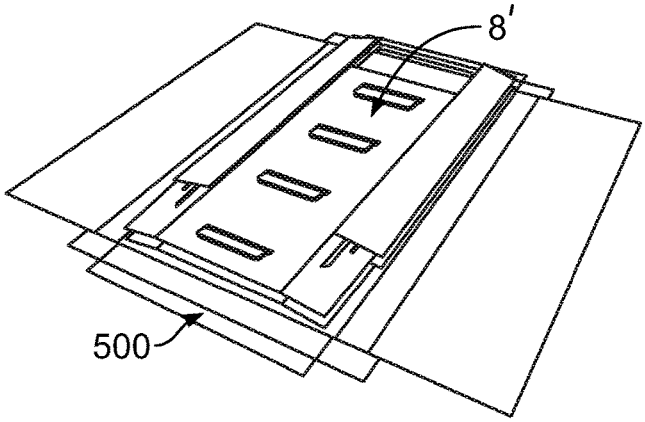
FIG. 11A is a perspective view of a fully collapsed hutch unit placed on a shipper prior to closure of the shipper.
Figure 11B:
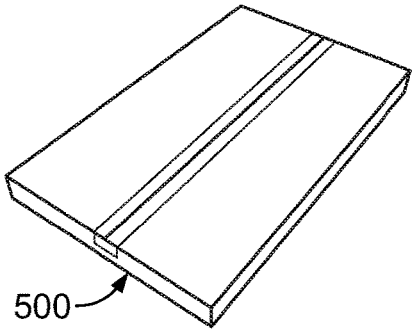
FIG. 11B is a perspective view of a shipper enclosing the hutch unit for shipping.

It should be understood that the described hutch unit 8 is configured to be convertible between a first, flat configuration 8', i.e., a collapsed configuration, in which the front and back sidewall sections 112*a*, 112*b* and 114*a*, 114*b* of each sidewall 112, 114 are positioned in abutting relationship, see FIGS. 10 and 11A, and a second, erected configuration 8 in which the front and back sidewall sections 112*a*, 112*b* and 114*a*, 114*b* of each sidewall 112, 114 are positioned in substantially coplanar relationship, see FIG. 8. Further, it should be understood that the step of adhering the upper edge flaps 126*a*, 130*a* and 126*b*, 130*b* to the sidewall sections 112*a*, 114*a* and the back flaps 212, 214 can be performed after the hutch unit 8 is configured in the collapsed configuration, such as for shipping in a shipping container or shipper 500, see FIGS. 11A and 11B, and subsequently configured in the erected configuration, such as at a retail or other end use location.

Referring to FIG. 10, following assembly of the back member 215 to the front member 115, as described with reference to FIGS. 7 and 8, the front member 115 can be displaced upward relative to the back member 215, as guided by the vertical sliding connections defined by the ratchet rivets 30 extending through the connector apertures 134*a*, 134*b*, 136*a*, 136*b* and slots 222*a*, 222*b*, 224*a*, 224*b*. At the same time, the front and back sidewall sections 112*a*, 112*b* pivot toward each other about the vertical fold line 112*c* and the front and back sidewall sections 114*a*, 114*b* pivot toward each other about the vertical fold line 114*c*, moving the vertical fold lines 112*c*, 114*c* outward from the shelf units 300'. Further, the shelf units 300' are pivoted about the hinge connections defined at the front shelf edge 320 and rear shelf edge 314, wherein the shelf units 300' pivot downward to a position generally parallel the front panel 110 and back panel 210. In the collapsed configuration, the generally flat hutch unit 8' can be placed in the shipper 500, see FIG. 11A, and the shipper folded around the hutch unit 8' for shipping, see FIG. 11B.

At a retail or other end use location, the hutch unit can be erected by sliding the back member 215 upward relative to the front member 115, as guided by the sliding connections at the rivets 30. The upward movement of the back member 215 relative to the front member 115 causes the shelf units 300' to pivot toward a position generally perpendicular to the front and back panels 110, 210, moving the front and back panels 110, 210 away from each other as well as pivoting the front and back sidewall sections 112*a*, 114*a* and 112*b*, 114*b* about the respective vertical fold lines 112*c*, 114*c* to define generally planar outer surfaces 112*s*, 114*s* at the sidewalls 112, 114 of the hutch unit 8.

The upper edge flaps 126*a*, 130*a* and 126*b*, 130*b* can be adhered to respective sidewall sections 112*a*, 114*a* and back flaps 212, 214 to provide a completed hutch unit 8, as seen in FIG. 8, wherein the adhered connection between the upper edge flaps 126*a*, 130*a* and 126*b*, 130*b* and the sidewall sections 112*a*, 114*a* and back flaps 212, 214 can prevent relative vertical movement between the front and back members 115, 215 and further stabilize the hutch unit 8. The completed hutch unit 8 includes outer surfaces 110*s*, 112*s*, 114*s*, 210*s* defined by the front panel 110, sidewalls 112, 114, and back panel 210, respectively, wherein the outer sidewall surfaces 112*s*, 114*s* are oriented perpendicular to the outer surfaces 110*s*, 210*s* of the front and back panels 110, 210. The erected hutch unit 8 can be utilized as a display hutch for displaying products supported on the shelf units 300' and accessible through the front shelf openings 121*b*, 121*c*, 121*d*, as well as at the open top of the hutch unit 8 corresponding to the uppermost shelf unit 300'.

It should be noted that the tapered forward edges 322*a*, 324*a* of the shelf flaps 322, 324 can provide clearance for pivotal movement of the front sidewall sections 112*a*, 114*a* relative to the front panel 110 as the shelf units 300' pivot through positions that are angled relative to the front panel 110. Further, the shelf flaps 322, 324 can pivot outward as the hutch unit is converted to the collapsed configuration, and the shelf flaps 322, 324 can pivot inward to a position generally perpendicular to the shelf panel 310' as the hutch unit is converted to the erected configuration, wherein the shelf flaps 322, 324 can provide additional rigidity to the shelf unit 300' in the erected configuration.

It should be understood that although the hutch unit 8 described herein includes four shelf units 300', the hutch unit 8 can be figured with less or more shelf units 300' depending of the display requirements for the hutch unit 8. Further, it may be understood that the vertical sliding connections defined at the rivets 30 along with the rigid shelf units 300' spanning from the front panel 110 to the back panel 210 enables a stable erected hutch unit 8, that further includes a sliding configuration that can accommodate different numbers of shelf units 300' without altering the operation of the hutch unit 8 in being converted between a collapsed configuration and an erected configuration.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hutch unit comprising:

a front panel and two laterally opposing sidewalls, each sidewall including a front sidewall edge hingedly connected to the front panel along a front sidewall fold line;

a back panel;

one or more shelf units, each shelf unit hingedly connected to the front panel adjacent to a front shelf edge, and each shelf unit hingedly connected to the back panel adjacent to a rear shelf edge;

the back panel having opposing lateral back edges;

first and second back flaps hingedly connected to the lateral back edges extending forward from the back panel, each of the first and second back flaps positioned in abutting relationship to a respective sidewall to define first and second overlapping sidewall portions along each sidewall; and vertical sliding connections joining the back flaps to the sidewalls at the overlapping sidewall portions, wherein the vertical sliding connections guide the back flaps in vertical displacement relative to the sidewalls.

2. The hutch unit as set forth in claim 1, wherein the front panel, back panel, and sidewalls each define an outer surface of the hutch unit.

3. The hutch unit as set forth in claim 1, wherein each sidewall comprises a front sidewall section and a back sidewall section hingedly connected to each other along a vertical sidewall fold line parallel to the front sidewall fold lines.

4. The hutch unit as set forth in claim 3, wherein the overlapping sidewall portions are defined along the back sidewall sections.

5. The hutch unit as set forth in claim 4, wherein the vertical sliding connection on each overlapping sidewall portion is defined by a vertically elongated slot defined in one of the back flap and the back sidewall section, and a connecting member extending from the other of the back flap and the back sidewall section through the vertically elongated slot.

6. The hutch unit as set forth in claim 3, wherein the hutch unit is convertible between a first, flat configuration in which the front and back sidewall sections of each sidewall are positioned in abutting relationship, and a second, erected configuration in which the front and back sidewall sections of each sidewall are positioned in substantially coplanar relationship.

7. The hutch unit as set forth in claim 6, wherein the one or more shelf units are positioned in substantially flat abutting relationship to the front and back panels in the first, flat configuration, and the one or more shelf units are positioned to define one or more support surfaces between the front and back panels and extend adjacent to the front and back sidewall sections of each sidewall in the second, erected configuration.

8. The hutch unit as set forth in claim 1, wherein the vertical sliding connection on each overlapping sidewall portion is defined by a vertically elongated slot defined in one of the back flap and the sidewall, and a connecting member extending from the other of the back flap and the sidewall through the vertically elongated slot.

9. The hutch unit as set forth in claim 8, wherein a pair of vertically spaced vertical sliding connections is provided on each of the overlapping sidewall portions.

10. The hutch unit as set forth in claim 1, wherein one or more of the shelf units includes a generally planar shelf panel defining the front and rear shelf edges and opposing lateral shelf edges, and a shelf flap hingedly connected to each lateral shelf edge and extending between the front and rear shelf edges generally parallel to the sidewalls.

11. A hutch unit comprising:

a front panel and two laterally opposing sidewalls, each sidewall including a front sidewall edge hingedly connected to the front panel along front sidewall fold lines;

a back panel;

one or more shelf units, each shelf unit including a generally planar shelf panel, each shelf unit hingedly connected to the front panel adjacent to a front shelf edge, and each shelf unit hingedly connected to the back panel adjacent to a rear shelf edge, and each shelf unit including opposing lateral shelf edges;

the back panel defining an outer surface of the hutch unit and including back flaps supported on each of the sidewalls for vertical displacement relative to the sidewalls parallel to the front sidewall fold lines.

12. The hutch unit as set forth in claim 11, wherein the back flaps comprise first and second back flaps hingedly connected to opposing lateral back edges of the back panel and extending forward from the back panel, each of the first and second back flaps positioned in abutting relationship to a respective sidewall to define first and second overlapping sidewall portions along each sidewall.

13. The hutch unit as set forth in claim 12, including vertical sliding connections joining the back flaps to the sidewalls at the overlapping sidewall portions, wherein the vertical sliding connections guide the back panel in the vertical displacement relative to the sidewalls.

14. The hutch unit as set forth in claim 12, wherein each sidewall comprises a front sidewall section and a back sidewall section hingedly connected to each other along a vertical sidewall fold line parallel to the front sidewall fold lines, and the overlapping sidewall portions are defined along the back sidewall sections.

15. The hutch unit as set forth in claim 14, wherein each of the back flaps includes a pair of vertically elongated slots extending parallel to the front sidewall fold lines, and a pair of vertical sliding connections are provided on each of the overlapping sidewall portions by a shaft of a fastener extending through a respective vertically elongated slot in the back flap and through an adjacent back sidewall section.

16. The hutch unit as set forth in claim 14, wherein the hutch unit is convertible between a first, flat configuration in which the front and back sidewall sections of each sidewall are positioned in abutting relationship, and a second, erected configuration in which the front and back sidewall sections of each sidewall are positioned in substantially coplanar relationship.

17. A method of assembling a hutch unit comprising:

providing a first blank comprising a front panel having lateral front edges and sidewalls hingedly connected to the front panel at respective front sidewall fold lines defined at the lateral front edges, shelf openings defined in the front panel and vertically separated by front face sections;

providing a second blank comprising a back panel having lateral back edges and back flaps hingedly connected to the back panel at respective back fold lines defined at the lateral back edges;

folding the sidewalls of the first blank about the front sidewall fold lines to form a generally U-shaped front member;

folding the back flaps of the second blank about the back fold lines to form a generally U-shaped back member;

positioning the back flaps in overlapping relation to respective ones of the sidewalls to define first and second overlapping sidewall portions;

positioning connecting members through each of the first and second overlapping portions including positioning each connecting member through a vertically elongated slot, extending parallel to the front sidewall fold lines, defined in at least one of the back flap and the sidewall of each overlapping portion to form a vertical sliding connection;

wherein positioning the back flaps in overlapping relation to respective ones of the sidewalls includes positioning shelf units generally perpendicular to the front panel and connected to the front panel and the back panel.

18. The method as set forth in claim 17, wherein each shelf unit is formed from a third blank including a generally planar shelf panel and a front shelf tab hingedly connected to a front shelf edge and attached to a respective front face section, and positioning the shelf units comprises pivoting the shelf units from a position generally parallel the front panel to a position generally perpendicular to the front panel.

19. The method as set forth in claim 18, including shelf flaps hingedly connected to the shelf panel at opposing lateral shelf edges, and positioning the shelf units includes folding the shelf flaps generally perpendicular to the shelf panel.

20. The method as set forth in claim 19, wherein the third blank further comprises a rear shelf tab extending from a rear shelf edge of the shelf panel, and positioning the back flaps in overlapping relation to respective ones of the sidewalls includes moving the front panel and back panel toward each other to position the rear shelf tab of each shelf unit through a respective horizontal slot in the back panel.

21. The method as set forth in claim 17, wherein each sidewall includes front and back sidewall sections hingedly joined at respective vertical sidewall fold lines parallel to the front sidewall fold lines, and positioning connecting members through the overlapping portions comprises positioning a pair of connecting members through each of the back sidewall sections at vertically spaced locations aligned with respective vertically elongated slots.

* * * * *